US009558681B2

(12) United States Patent
Tobol et al.

(10) Patent No.: US 9,558,681 B2
(45) Date of Patent: Jan. 31, 2017

(54) LABELS AND METHODS OF PRODUCING THE SAME

(71) Applicant: R. R. Donnelley & Sons Company, Chicago, IL (US)

(72) Inventors: Gretchen M. Tobol, Grand Island, NY (US); James Warmus, La Grange, IL (US)

(73) Assignee: R.R. DONNELLEY & SONS, Chicago, IL (US)

( * ) Notice: Subject to any disclaimer, the term of this patent is extended or adjusted under 35 U.S.C. 154(b) by 172 days.

(21) Appl. No.: 14/024,295

(22) Filed: Sep. 11, 2013

(65) Prior Publication Data

US 2015/0072097 A1 Mar. 12, 2015

(51) Int. Cl.

| | |
|---|---|
| ***G09F 3/00*** | (2006.01) |
| ***G09F 3/10*** | (2006.01) |
| ***B31D 1/02*** | (2006.01) |
| *G09F 3/02* | (2006.01) |

(52) U.S. Cl.

CPC ..... *G09F 3/0297* (2013.01); *B31D 1/021* (2013.01); *B31D 1/026* (2013.01); *B31D 1/027* (2013.01); *B31D 1/028* (2013.01); *G09F 3/0292* (2013.01); *G09F 3/10* (2013.01); *G09F 2003/0222* (2013.01); *G09F 2003/0255* (2013.01); *G09F 2003/0257* (2013.01); *G09F 2003/0272* (2013.01); *Y10T 156/108* (2015.01);

(Continued)

(58) Field of Classification Search

CPC ... Y10T 156/1057; B31D 1/021; B31D 1/026; B31D 1/028; G09F 3/0297; G09F 3/10

See application file for complete search history.

(56) References Cited

U.S. PATENT DOCUMENTS

| | | | | |
|---|---|---|---|---|
| 4,824,498 A * | 4/1989 | Goodwin | ..... | A47G 27/0468 156/71 |
| 5,284,363 A * | 2/1994 | Gartner | ..... | G09F 3/10 283/101 |
| 6,281,795 B1 | 8/2001 | Smith et al. | | |

(Continued)

OTHER PUBLICATIONS

William Frick & Company Innovations in Identification, "Tamper Evident RFID Label",retrieved from the internet:>http://www.fricknet.com/Products/SmartMark_RFID/Tamper_Evident_RFID_Label.html>, last visited on Sep. 11, 2013, 5 pages.

(Continued)

*Primary Examiner* — Mark A Osele
*Assistant Examiner* — Christopher C Caillouet
(74) *Attorney, Agent, or Firm* — Hanley, Flight & Zimmerman, LLC

(57) ABSTRACT

Labels having identification tags and tamper evident pattern release layers and methods of producing such labels are disclosed. An example method includes moving a first substrate in a direction. The first substrate has a first side opposite a second side. The first side has a first adhesive and a pattern release layer. The method also includes coupling a third side of a tag to the first side of the first substrate. The tag includes the third side and a fourth side opposite the third side. The method also includes mating transfer tape of a second substrate over the first side and the fourth side. The second substrate includes a liner layer and the transfer tape. The transfer tape is to be positioned immediately adjacent the tag.

26 Claims, 9 Drawing Sheets

(52) U.S. Cl.
CPC .... *Y10T 156/1062* (2015.01); *Y10T 156/1084* (2015.01); *Y10T 428/1476* (2015.01)

(56) References Cited

U.S. PATENT DOCUMENTS

| | | | | |
|---|---|---|---|---|
| 6,451,154 | B1 * | 9/2002 | Grabau | G06K 17/0025 156/300 |
| 7,855,649 | B2 | 12/2010 | Masin | |
| 8,282,011 | B1 | 10/2012 | Skoine et al. | |
| 2002/0067264 | A1 * | 6/2002 | Soehnlen | B65D 5/42 340/572.1 |
| 2004/0119593 | A1 * | 6/2004 | Kuhns | G06K 19/027 340/572.7 |
| 2004/0166286 | A1 * | 8/2004 | Auchter | G09F 3/10 428/136 |
| 2006/0061475 | A1 * | 3/2006 | Moskowitz | G06K 19/0739 340/572.3 |
| 2010/0043694 | A1 * | 2/2010 | Patel | G09F 3/0292 116/201 |

OTHER PUBLICATIONS

Canadian Intellectual Property Office, "Examiner's Report", issued in connection with Canadian Application No. 2,861,347, issued on Nov. 13, 2015, 3 pages.

Canadian Intellectual Property Office, "Examiner's Report", issued in connection with Canadian Application No. 2,861,347, issued on Aug. 31, 2016, 5 pages.

* cited by examiner

LABELS AND METHODS OF PRODUCING THE SAME

FIELD OF THE DISCLOSURE

This disclosure relates generally to labels and, in some examples, to labels having identification tags and tamper evident pattern release layers and methods of producing such labels.

BACKGROUND

Labels may be affixed to packages, containers and/or products for identification and/or shipping purposes.

BRIEF DESCRIPTION OF THE DRAWINGS

To clarify multiple layers and regions, the thickness of the layers are enlarged in the drawings. Wherever possible, the same reference numbers will be used throughout the drawing(s) and accompanying written description to refer to the same or like parts.

DETAILED DESCRIPTION

Figure 1:
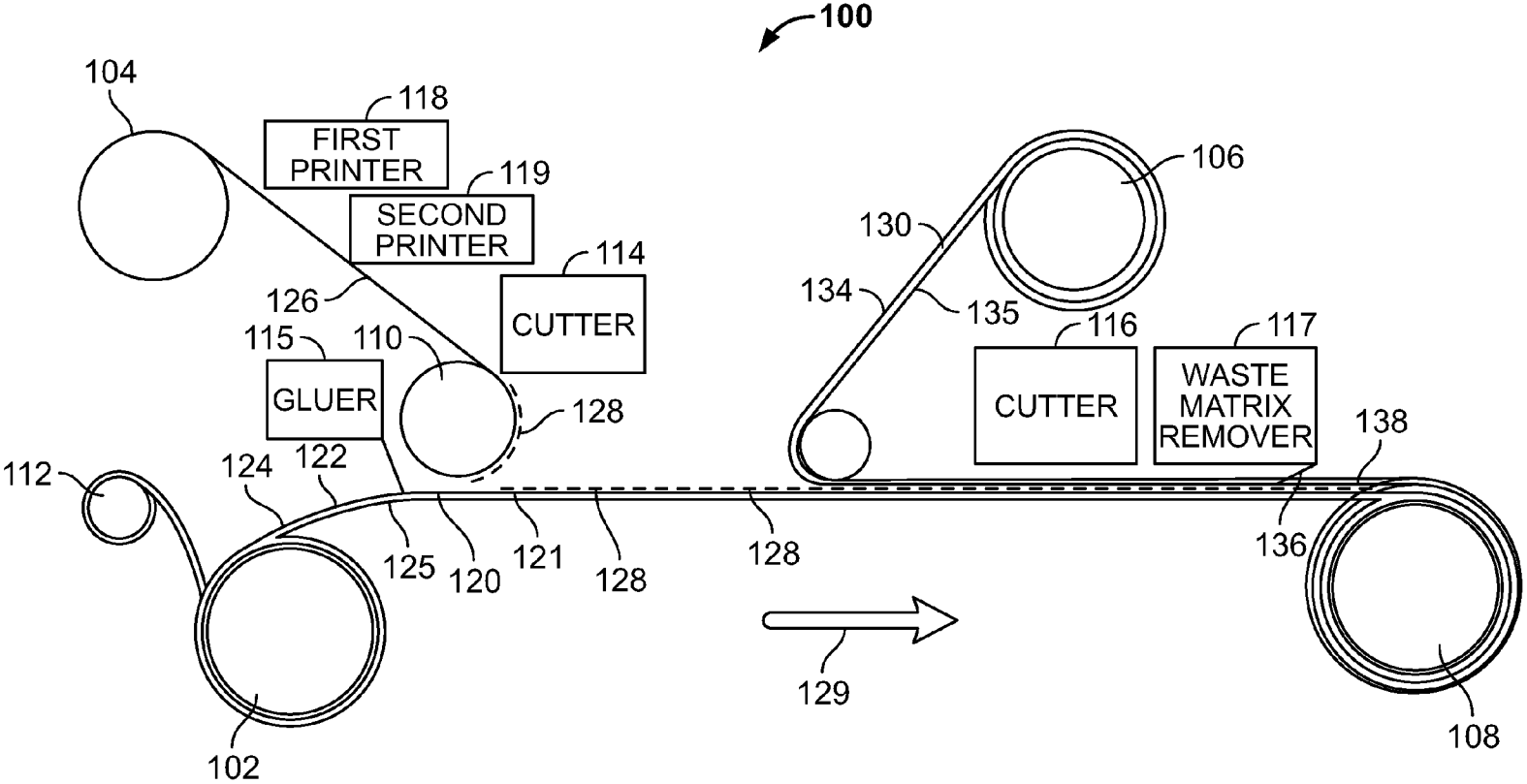
FIG. 1 illustrates an example apparatus to produce example labels in accordance with the teachings of this disclosure.

The examples disclosed herein relate to example brand protection and/or security labels produced in an in-line process. In some examples, the example labels are produced using label stock and/or a first layer, a tag and transfer tape and/or a second layer. In some examples, the label stock has tamper indicating and/or tamper evident properties such as, for example, a pattern release layer that enables indicia, a word and/or a symbol (e.g., the word "void") to be visible if the label is tampered with (e.g., removed from the substrate/container to which the label is attached). In some examples, the tag is a radio-frequency identifier (RFID) tag and/or a near field communication (NFC) tag.

To produce the example labels disclosed herein, in some examples, label stock is unwound from a roller and an example tag is coupled to a first side of the label stock. In some examples, the first side of the label stock has a layer of first adhesive to which a second side of the tag is coupled. In some examples, transfer tape is coupled to the first side of the label stock and a third side of the tag opposite the second side. In some examples, a liner is coupled to the transfer tape opposite the tag and the label stock. In some examples, the transfer tape is a film between two layers of adhesive and/or opposing surfaces of second adhesive. The second adhesive may be stronger than the first adhesive to enable the tag to separate from the label stock and remain attached to the transfer tape if the label stock is removed from, for example, a product container and/or a shipping container to which the label stock was coupled. However, in other examples, to enable the tag to be voided and/or disabled if the label stock is removed from the product container and/or tampered with, first and second portions of the tag are configured to separate from each other such that the first tag portion remains coupled to the product and the second tag portion remains coupled to the label stock.

When the label (e.g., the label stock, the tag and the transfer tape) is removed from the liner and affixed to, for example, a container (e.g., a box, a shipping container, a pallet, a product container, etc.), the label may be used to authenticate the product and/or products within the container. For example, the product may be authenticated using a reader that identifies, obtains and/or retrieves information from the tag and/or by visually verifying that the label has not been tampered with. In other examples, the label may be used as a primary label directly affixed to a product (e.g., a bottle of sun tan lotion, shampoo, etc.), and may be similarly used for authentication purposes. Regardless of the product and/or container (e.g., substrate) to which the label is affixed, if the label stock is removed from the container (e.g., shipping container) to which the label is stuck and/or affixed after being removed from the liner, the label stock indicates that tampering has occurred. The label stock may visually indicate tampering by the release layer staying affixed to the substrate and separating from the label stock. In some examples, the label indicates that tampering has occurred by the label stock including a pattern in its adhesive or a breakaway coating that enables the label stock to separate from the adhesive and visually indicate tampering after the label stock is removed from the substrate (e.g., shipping container).

Additionally or alternatively, in some examples, the tag and the label stock separate as the label stock is removed from the container because the second adhesive bond and/or coupling between the tag and the container is stronger than the first adhesive bond and/or coupling between the tag and the label stock. Thus, once the label stock has been removed from the container, the tag remains coupled to the substrate via the second adhesive and/or the transfer tape.

Additionally or alternatively, in some examples, based on the configuration of the tag, as the label stock is removed from the container, the tag is physically altered, disabled and/or voided. In some such examples, to enable the tag to be altered, disabled and/or voided, the antenna of the example tags include a removable bridge that remains coupled to the antenna/tag if the label is not tampered with but is removed from the antenna/tag if the label is tampered with. For example, prior to the label being tampered with, the bridge connects a break in the antenna to enable the antenna and/or the tag to be operable for product authentication purposes. However, if the label stock is tampered with and/or when the label stock is removed from the container, the bridge is configured to detach from the antenna/tag and remain affixed to the label stock to re-create the break in the antenna and/or to disable and/or void the tag. In some examples, stronger adhesive (e.g., a spot coat) is included between the label stock and the removable bridge to substantially ensure that the label stock remains affixed to the bridge as the label stock is removed from the container.

In other examples, the example tags include lines of weakness to enable the tag and/or the antenna to be torn and/or a portion of the tag to be removed (e.g., removable tag portion) as the label stock is removed from the container and/or when the label is tampered with. In some examples, stronger adhesive (e.g., a spot coat) is included between the label stock and the removable tag portion to enable the label stock to remain affixed to the removable tag portion as the label stock is removed from the container. Additionally or alternatively, in some examples, a release layer is included adjacent the removable tag portion on the side of the tag adjacent the transfer tape. In some such examples, the stronger adhesive is on a first side of the tag adjacent the label stock and the release layer is on the second side of the tag adjacent the transfer tape.

In some examples, removing a portion of the tag and/or the bridge changes the antenna and causes the tag to respond to different frequencies and/or have different impedance and/or frequency responses. For example, after the antenna, chip and/or tag is altered (e.g., the bridge is removed), the antenna may be used to obtain information about the container, but may not be used to authenticate the product to which the remaining portion of the antenna is affixed.

FIG. 1 represents an example apparatus 100 that can be used to produce the example labels disclosed herein. In some examples, the apparatus 100 may be an in-line process including first, second, third and fourth substrate movers 102, 104, 106 and 108, a vacuum cylinder 110, a liner remover 112, cutters 114, 116, a gluer 115, a waste matrix remover 117 and first and second printers 118, 119. While the stations and/or portions 102-119 of the apparatus 100 are depicted in one example order, the stations and/or portions 102-119 may be arranged differently and/or one or more of the stations and/or portions 102-119 may be removed and/or combined.

In some examples, during operation, the first substrate mover 102 feeds one or more pieces of a first substrate 120 and/or a web of the first substrate 120 into the apparatus 100. In some examples, the first substrate 120 is label stock 121 having first adhesive and/or a pattern release layer 122 on a first side 124 thereof and indicia and/or an identifier (e.g., a Quick Response (QR) code) on a second side 125 thereof. The indicia may include brand-related images and/or text, advertisement related images and/or text, instructional images and/or text, etc. However, in other examples, the second side 125 may not include any indicia and/or an identifier.

In some examples, the second substrate mover 104 feeds one or more pieces of a second substrate 126 and/or a web of the second substrate 126 toward the cutter 114. In this example, the second substrate 126 has a plurality of tags (e.g., RFID tags, NFC tags, etc.) and/or inlays 128 coupled thereto.

In some examples, the printers 118 and/or 119 print a removable bridge on the antenna of the inlays 128. In such examples, prior to the printers 118 and/or 119 printing on the inlays 128, the antennas of the inlays 128 include a break that substantially prevents the antenna from being used for product identification purposes. However, to close the break and form a removable bridge, the first printer 118 may print a release layer (e.g., a silicon release layer) on the break and the second printer 119 may print the removable bridge over the release layer. Thus, the bridge covers the break in the antenna enabling the antenna to be used for product identification purposes. In other examples, the printer(s) 118 and/or 119 may be used to print all and/or substantially all of the antenna (e.g., an RFID antenna) on the first side 124 of the first substrate 120. In some such examples, the apparatus 100 includes a chip positioner that positions a chip (e.g., an RFID chip, a NFC chip) on the first side (e.g., adjacent the antenna).

In examples in which the inlay 128 includes the removable bridge, the gluer 115 may apply adhesive (e.g., a relatively strong adhesive, spot coating) to the first side 124 of the first substrate 120 adjacent to where the bridge is to be positioned. Thus, if the label stock 121 is tampered with and/or removed from a container to which the label is affixed, the bridge remains coupled to the label stock 121 and separates from the remaining antenna/inlay 128 to enable the inlay 128 and/or the associated antenna to be voided and/or destroyed.

In some examples, the cutter 114 cuts the second substrate 126 to separate the inlays 128 from each other. Additionally or alternatively, in some examples, the cutter 114 forms one or more lines of weakness (e.g., die cuts, slits, etc.) in the inlays 128 to enable a portion of the inlays 128 to be removed and/or torn if the associated label is tampered with. In examples in which the inlay 128 includes the lines of weakness, the gluer 115 may apply adhesive (e.g., relatively strong adhesive, spot coating) to the first side 124 between where the lines of weakness are to be positioned. Thus, if the label stock 121 is tampered with and/or removed from a container to which the label is affixed, the removable tag portion (e.g., the portion of the tag between the lines of weakness) remains coupled to the label stock 121 and separates from the remaining antenna/inlay 128 to enable the inlay 128 and/or the associated antenna to be voided and/or destroyed.

In some examples, the vacuum cylinder 110 moves the separated inlays 128 toward and couples, positions, drops and/or places each inlay 128 onto the first side 124 of the first substrate 120 a spaced distance from one another as the first substrate 120 moves in a direction generally indicated by arrow 129.

In some examples, the third substrate mover 106 feeds one or more pieces of a third substrate 130 toward the first substrate 120 having the inlays 128 coupled thereto. In some examples, the third substrate 130 is transfer tape 134 having a liner layer 135 coupled thereto.

The cutter 116 may then cut the first substrate 120 and/or the third substrate 130 to separate the labels from one another. In some examples, the cutter 116 kiss-die cuts through the first substrate 120 and the transfer tape 134 to enable the label (e.g., at least a portion of one or more of the first substrate, the inlay 128 and the transfer tape 134) to be removed from the liner 135. In some examples, the cutter 116 forms a line of weakness (e.g., a perforation, a score, a cut) between the labels to enable the labels to be separated from one another. After the cutter 116 kiss-die cuts through the first substrate 120 and the transfer tape 134, the waste matrix remover 117 may remove a waste matrix 136 formed. However, in examples in which the cutter 116 does not kiss die-cut through the first substrate 120 and the transfer tape 134, the waste matrix remover 117 may not be provided. In some examples, the fourth substrate mover 108 may receive a web 138 of formed labels and wind the web 138 for shipment and/or packaging.

Figure 2:
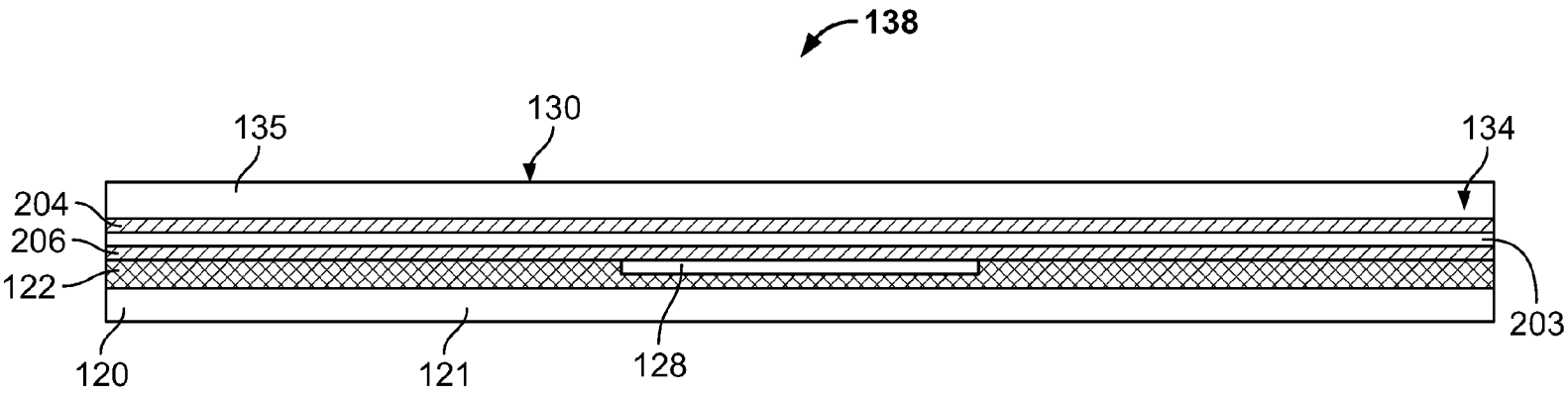
FIG. 2 illustrates a cross-sectional view of an example label produced in accordance with the teachings of this disclosure.

FIG. 2 shows a cross-sectional view of the web 138 produced using the example apparatus 100 of FIG. 1. In this example, the web 138 includes the first substrate 120, the inlay 128 and the second substrate 130. As shown in this example, the first substrate 120 includes the label stock 121 and the first adhesive and/or the pattern release layer 122 to which the inlay 128 is coupled. In this example, the third substrate 130 includes the transfer tape 134 and the liner layer 135 where the transfer tape 134 is a film 203 positioned between opposing layers of adhesive 204, 206 (second adhesive). In this example, the adhesive 206 is positioned immediately adjacent the inlay 128 and the adhesive 204 is positioned immediately adjacent the liner 202.

Figure 3:
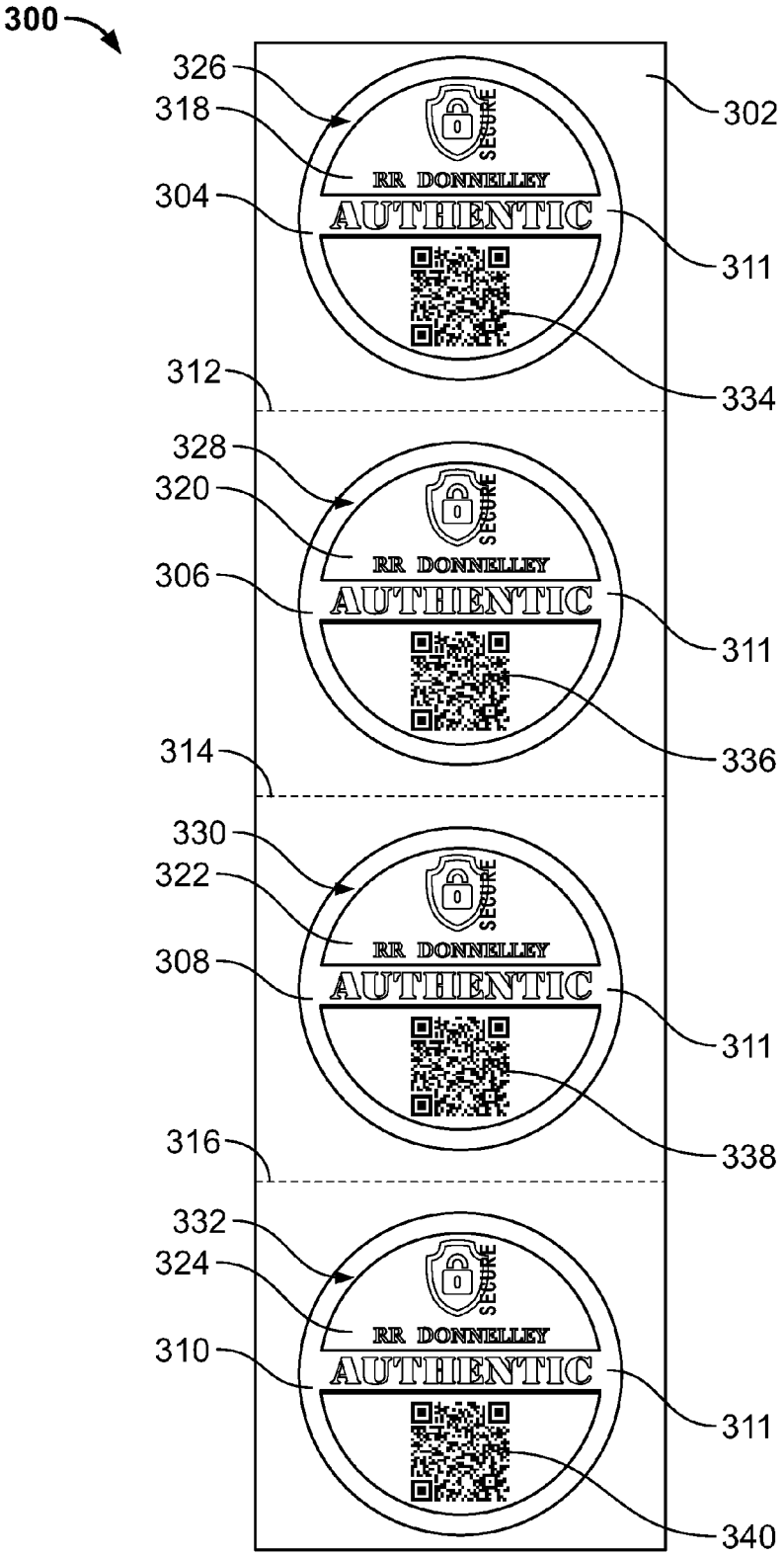
FIG. 3 illustrates an example web of labels in accordance with the teachings of this disclosure.

FIG. 3 depicts a top view of an example web 300 that can be produced using the example apparatus 100 of FIG. 1. In this example, the web 300 includes a liner layer 302 to which first, second, third and fourth labels 304, 306, 308 and 310 are coupled. In some examples, the labels 304, 306, 308, 310 are separated by lines of weakness and/or perforations 312, 314, 316 defined by the liner layer 302. In some examples, each of the labels 304, 306, 308, 310 includes label stock 311, a tag (e.g., RFID, NFC) and second adhesive (e.g., transfer tape) as disclosed herein. In this example, a surface (e.g., the second surface of the label stock 311) 318, 320, 322, 324 of the respective labels 304, 306, 308, 310 includes advertisements and/or indicia 326, 328, 330, 332 and an identifier (e.g., a QR code) 334, 336, 338, 340. While the example web 300 depicts the labels 304, 306, 308, 310 as being circular, the labels 304, 306, 308, 310 may be any other shape (e.g., rectangular, triangular, square, etc.).

Figure 4:
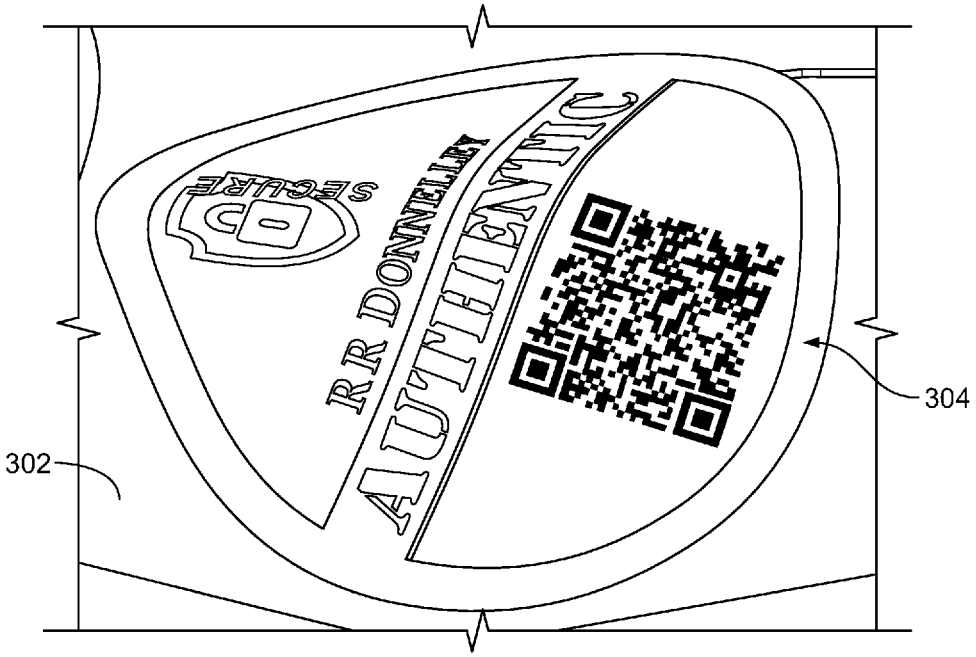
FIG. 4 illustrates a first side of an example label being removed from a liner.
Figure 5:
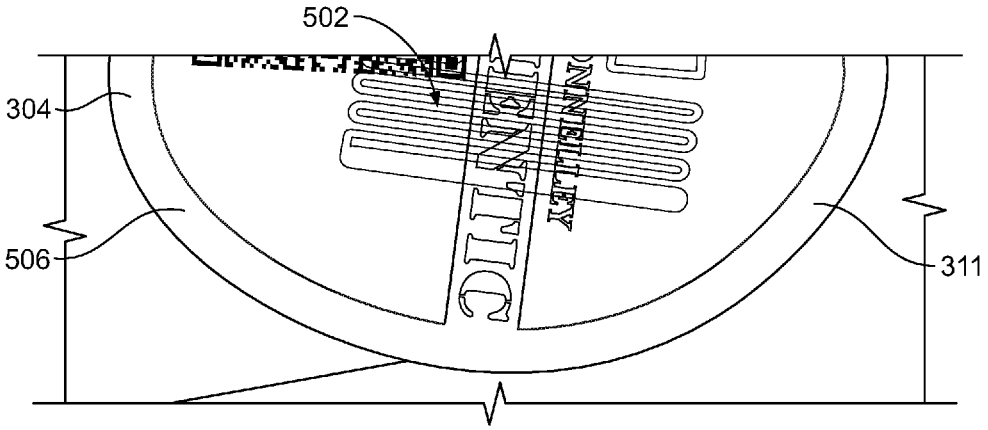
FIG. 5 illustrates a second side of the example label of FIG. 4 being removed from the liner.
Figure 6:
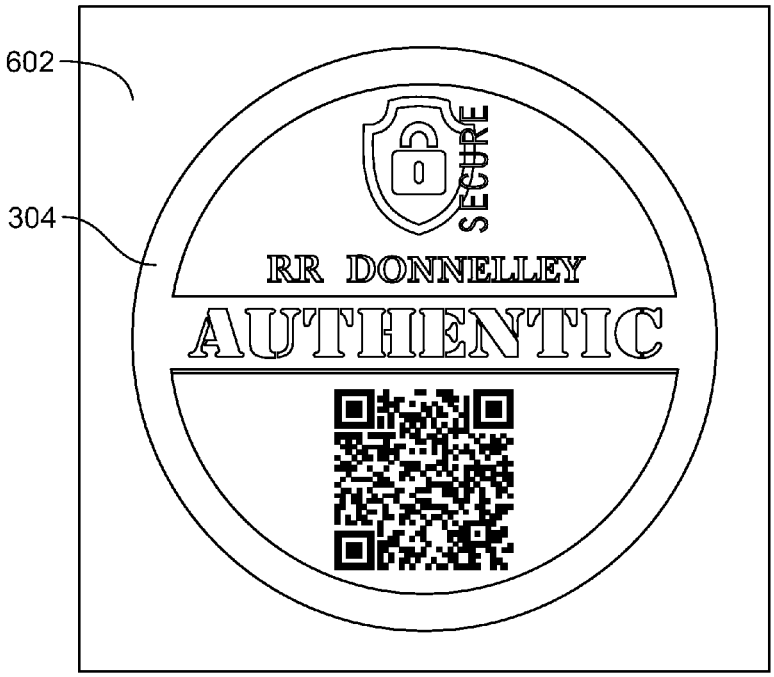
FIG. 6 illustrates the example label of FIG. 4 coupled to a container.
Figure 7:
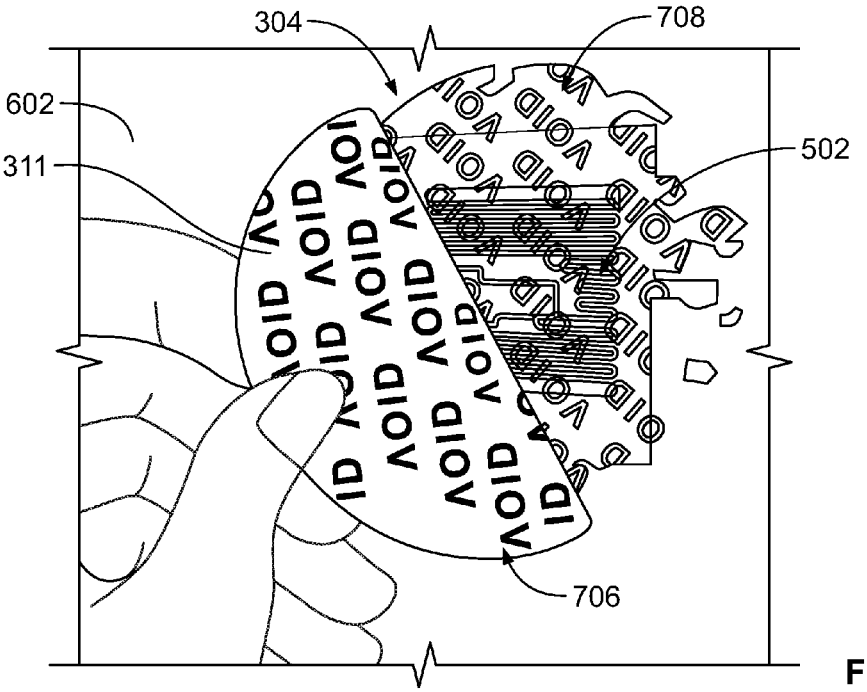
FIG. 7 illustrates the example label being removed from the container of FIG. 6.

FIG. 4 depicts an example top view of a label (e.g., the label 304) being peeled away from the liner layer 302 and FIG. 5 depicts a tag (e.g., an RFID tag) 502 of the label 304 coupled between the label stock 311 and second adhesive and/or transfer tape 506. FIG. 6 depicts the label 304 after being removed from the layer liner 404 and coupled to a container 602 such as, for example, a shipping container or a bottle of suntan lotion. FIG. 7 depicts the label stock 311 of the label 402 being removed from the tag 502 and, in doing so, providing a visual indication 706 that the label 402 has been tampered with by the separation of a pattern release layer 708 from the label stock 311.

Figure 10:
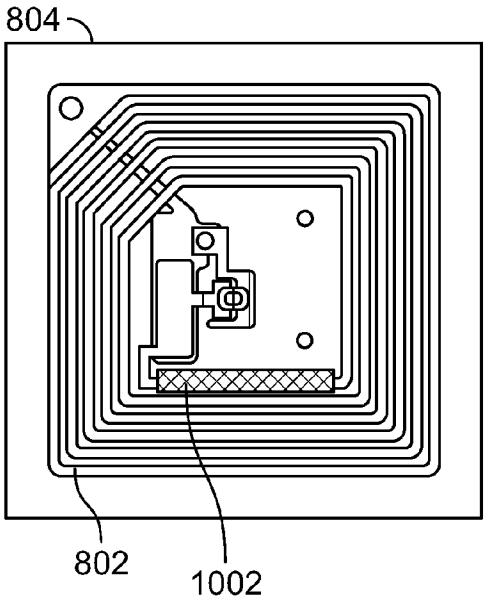
FIGS. 8-10 depict an example process of fabricating a removable bridge an example antenna in accordance with the teachings of this disclosure.
Figure 9:
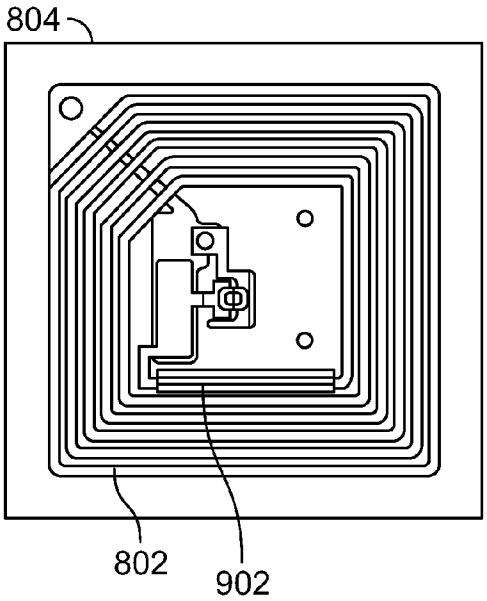
Figure 8:
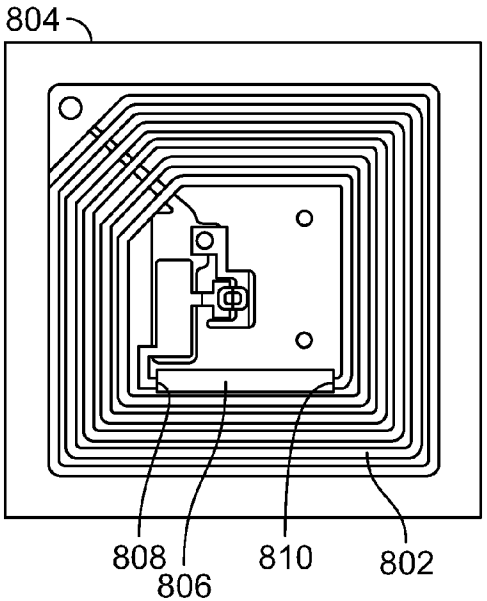

FIGS. 8-10 depict a process of fabricating a removable bridge 1002 on an antenna 802 of an inlay and/or tag 804 in accordance with the teachings of this disclosure. FIG. 8 shows a break 806 that separates a first antenna portion 808 and a second antenna portion 810 where the break 802 prevents the antenna 802 from functioning as intended and/or from functioning to authenticate goods. FIG. 9 shows a release layer (e.g., a silicon release layer) 902 on the antenna 802 and FIG. 10 shows the bridge 1002 on the antenna 802 where the bridge 1002 connects the first and second antenna portions 808, 810. In some examples, the first printer 118 prints the release layer 902 on the inlay 804 and the second printer 119 prints the bridge 1002 on the antenna 802. The release layer 902 may enable the bridge 1002 to be relatively easily removed from the antenna portions 808, 810 if the associated label is tampered with as described below.

In practice, if the label stock 311 to which the inlay 804 is coupled is removed from the container 602, as described above, the release layer 902 enables the bridge 1002 to separate from the antenna portions 808, 810 such that the bridge 1002 remains coupled to the label stock 311 while the remainder of the inlay 804 remains coupled to the container 602. Thus, in such examples, if the label (e.g., 304) is tampered with, the bridge 1002 is removed from the antenna 802 providing the break 806 in the antenna 802 and preventing the antenna 802 from operating as intended. For example, removing the bridge 1002 may prevent the antenna 802 from functioning to authenticate goods and/or cause the antenna 802 to operate at a different frequency. In some examples, adhesive (e.g., a relatively strong adhesive) is provided between the label stock 311 and the bridge 1002, via the gluer 115, to substantially ensure that bridge 1002 remains coupled to the label stock 311 if the label stock 311 is removed from the container 602.

Figure 11:
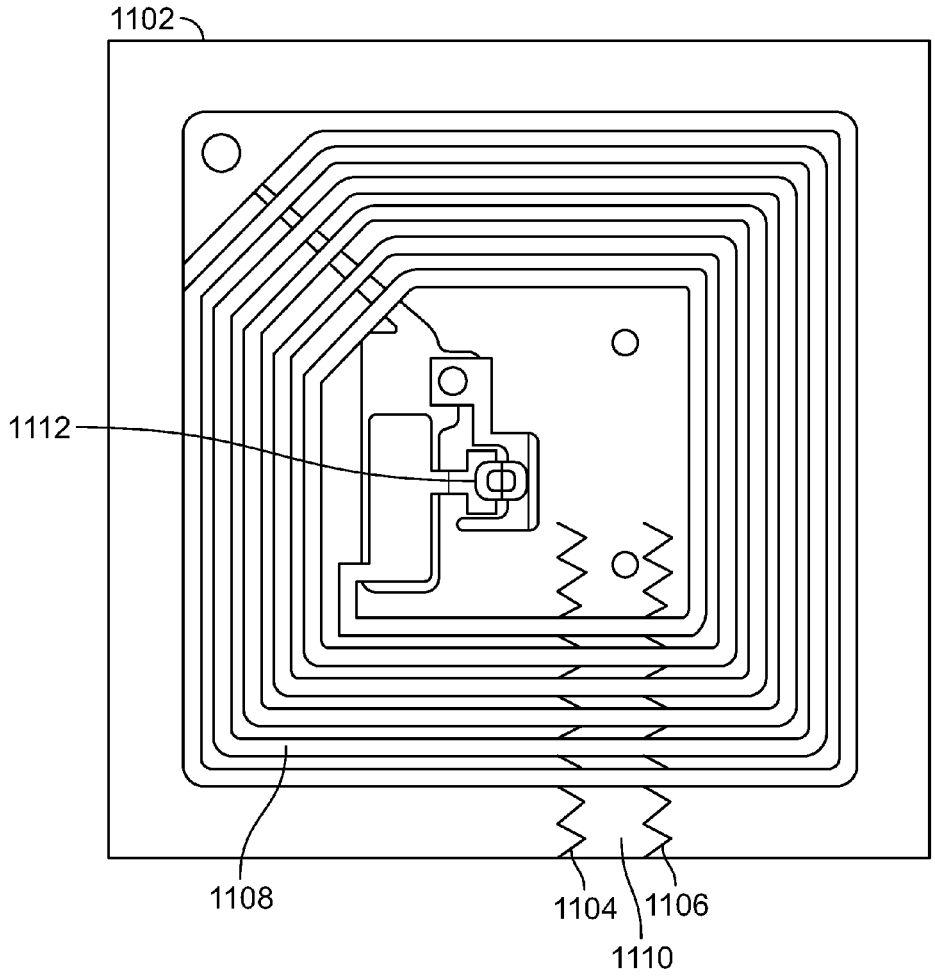
FIG. 11 depicts an example tag having lines of weakness that define an example removable portion in accordance with the teachings of this disclosure.

FIG. 11 depicts an example inlay and/or tag 1102 including lines of weakness 1104, 1106 formed through the inlay 1102 and/or adjacent an antenna 1108. In some examples, the lines of weakness 1104, 1106 form a removable portion 1110 which, when removed, prevents the antenna 1108 from functioning as intended and/or to authenticate goods.

In practice, if the label stock 311 to which the inlay 1102 is coupled is removed from the container 602, as described above, the coupling between the removable portion 1110 and the label stock 311 causes the removable portion 1110 to be separated from the surrounding inlay 1102 along the lines of weakness 1104 and/or 1106 while the remainder of the inlay 804 remains coupled to the container 602. Thus, in such examples, if the label (e.g., 304) is tampered with, the inlay 1102 is torn along the lines of weakness 1104, 1106, which tears the antenna 1108 and prevents the antenna 1108 from operating as intended. In some examples, adhesive (e.g., a relatively strong adhesive) is provided between the label stock 311 and the removable portion 1110, via the gluer 115, to substantially ensure that the removable portion 1110 remains coupled to the label stock 311 if the label stock 311 is being removed from the container 602. While FIG. 11 shows the lines of weakness 1104, 1106 positioned in particular locations on the example inlay 1102, the lines of weakness 1104, 1106 may be differently positioned (e.g., adjacent a chip 1112 of the inlay 1102). While two lines of weakness are shown in the inlay 1102, the inlay 1102 may include any number of lines of weakness (e.g., 1, 3, 4, etc.).

Figure 12:
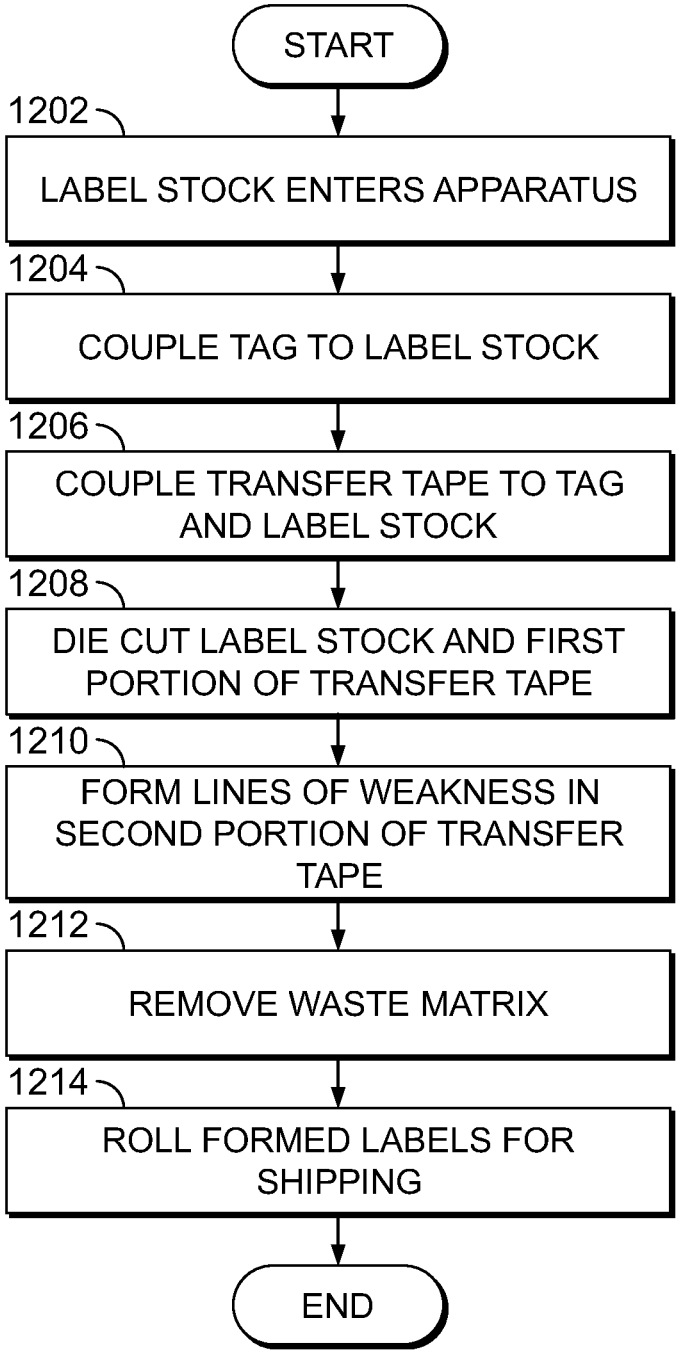
FIG. 12 is a flowchart representation of an example process, which may be implemented using machine readable instructions to produce the example labels of FIGS. 2-7.

While an example manner of implementing the apparatus 100 of FIG. 1 has been illustrated in FIG. 12, one or more of the elements, processes and/or devices illustrated in FIG. 12 may be combined, divided, re-arranged, omitted, eliminated and/or implemented in any other way. Further, the example stations and/or portions 102-119 and/or, more generally, the example apparatus of FIG. 1 may be implemented by hardware, software, firmware and/or any combination of hardware, software and/or firmware. Thus, for example, any of the example stations and/or portions 102-119 and/or, more generally, the example apparatus 100 could be implemented by one or more circuit(s), programmable processor(s), application specific integrated circuit(s) (ASIC(s)), programmable logic device(s) (PLD(s)) and/or field programmable logic device(s) (FPLD(s)), etc. When any of the apparatus or system claims of this patent are read to cover a purely software and/or firmware implementation, at least one of the example stations and/or portions 102-119 are hereby expressly defined to include a tangible computer readable medium such as a memory, DVD, CD, Blu-ray, etc. storing the software and/or firmware. Further still, the example flowchart of FIG. 12 may include one or more elements, processes and/or devices in addition to, or instead of, those illustrated in FIG. 12, and/or may include more than one of any or all of the illustrated elements, processes and devices.

A flowchart representative of example machine readable instructions for implementing the apparatus 100 of FIG. 1 is shown in FIG. 12. In this example, the machine readable instructions comprise a program for execution by a processor such as the processor 1312 shown in the example computer 1300 discussed below in connection with FIG. 13. The program may be embodied in software stored on a tangible computer readable medium such as a CD-ROM, a floppy disk, a hard drive, a digital versatile disk (DVD), a Blu-ray disk, or a memory associated with the processor 1312, but the entire program and/or parts thereof could alternatively be executed by a device other than the processor 1312 and/or embodied in firmware or dedicated hardware. Further, although the example program is described with reference to the flowchart illustrated in FIG. 12, many other methods of implementing the example apparatus 100 may alternatively be used. For example, the order of execution of the blocks may be changed, and/or some of the blocks described may be changed, eliminated, or combined.

As mentioned above, the example processes of FIG. 12 may be implemented using coded instructions (e.g., computer readable instructions) stored on a tangible computer readable medium such as a hard disk drive, a flash memory, a read-only memory (ROM), a compact disk (CD), a digital versatile disk (DVD), a cache, a random-access memory (RAM) and/or any other storage media in which information is stored for any duration (e.g., for extended time periods, permanently, brief instances, for temporarily buffering, and/or for caching of the information). As used herein, the term tangible computer readable medium is expressly defined to include any type of computer readable storage and to exclude propagating signals. Additionally or alternatively, the example processes of FIG. 12 may be implemented using coded instructions (e.g., computer readable instructions) stored on a non-transitory computer readable medium such as a hard disk drive, a flash memory, a read-only memory, a compact disk, a digital versatile disk, a cache, a random-access memory and/or any other storage media in which information is stored for any duration (e.g., for extended time periods, permanently, brief instances, for temporarily buffering, and/or for caching of the information). As used herein, the term non-transitory computer readable medium is expressly defined to include any type of computer readable medium and to exclude propagating signals. As used herein, when the phrase "at least" is used as the transition term in a preamble of a claim, it is open-ended in the same manner as the term "comprising" is open ended. Thus, a claim using "at least" as the transition term in its preamble may include elements in addition to those expressly recited in the claim.

FIG. 12 represents an example method of producing the example labels disclosed herein. While the processes of the method are depicted as being performed sequentially, one or more of the processes may be performed in parallel, for example. The process of FIG. 12 may begin by the first substrate mover 102 unwinding label stock and/or a first substrate from a roll and/or moving one or more pieces of the label stock 121 into the apparatus 100 toward the vacuum cylinder 110 (block 1202). In some examples, as the label stock 121 moves toward the vacuum cylinder 110, the gluer 115 spot coats the label stock 121 where the bridge 1002 of the antenna 802 and/or where the lines of weakness 1104, 1106 are to be positioned. The second substrate mover 104 may unwind the second substrate 126 having the inlays 128 coupled thereto and the cutter 114 may cut the second substrate 126 to form the separate inlays and/or inlays 128. Additionally or alternatively, in some examples, the printers 118 and/or 119 print the bridge 1002 on the inlays 128 and/or the cutter 114 forms the lines of weakness 1104, 1106 on the inlays 128.

At block 1204, the vacuum cylinder 110 couples, places and/or drops the separate inlays 128 on the first side 124 of the first substrate 120 moving in the direction generally indicated by arrow 129 (block 1204). At block 1206, the third substrate mover 106 unwinds the transfer tape and/or third substrate 130 and couples and/or mates the third substrate 130 over the first side 124 of the first substrate 120 and the inlay 128 such that the transfer tape 134 is positioned immediately adjacent the inlay 128 between label stock 121 of the first substrate 120 and the liner layer 135 (block 1206). At blocks 1208, 1210, the cutter 116 cuts and/or kiss-die cuts the first substrate 120 and the transfer tape 134 to form the outline of the labels 304, 306, 308, 310, 402 and/or forms lines of weakness 312, 314, 316 in the liner layer 135 to separate the labels 304, 306, 308, 310, 402 from one another (block 1208, block 810). At block 1212, the waste matrix remover 117 removes the waste matrix 136 formed by the processes performed by the cutter 116 and at block 1214 the fourth substrate mover 108 winds the formed labels and/or web of formed labels for shipping and/or packaging (block 1212, block 1214).

Figure 13:
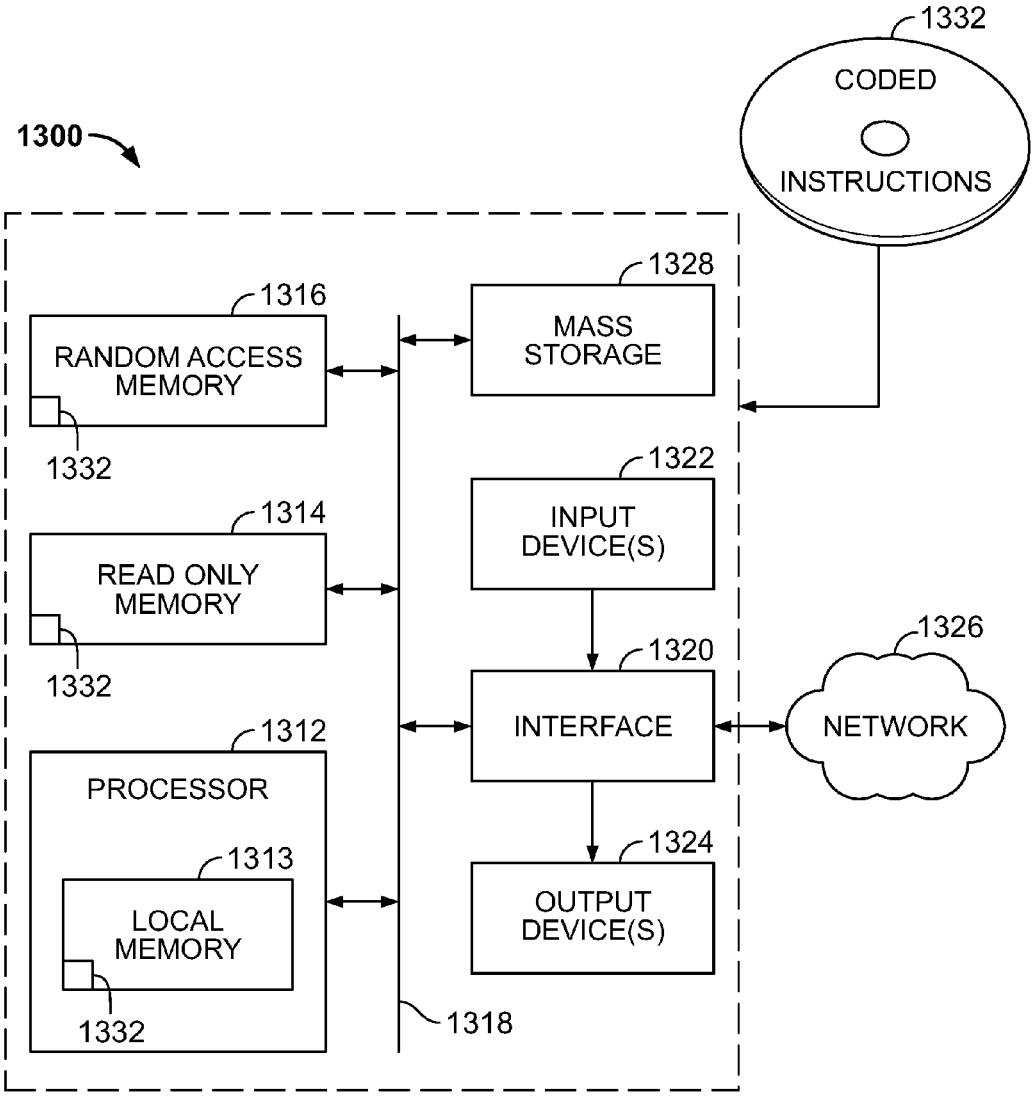
FIG. 13 is a block diagram of an example processor platform capable of executing the instructions of FIG. 12 to implement the apparatus of FIG. 1.

FIG. 13 is a block diagram of an example computer 1300 capable of executing the instructions of FIG. 12 to implement the apparatus 100 of FIG. 1. The computer 1300 can be, for example, a server, a personal computer, a, a personal digital assistant (PDA), an Internet appliance or any other type of computing device.

The system 1300 of the instant example includes a processor 1312. For example, the processor 1312 can be implemented by one or more microprocessors or controllers from any desired family or manufacturer.

The processor 1312 includes a local memory 1313 (e.g., a cache) and is in communication with a main memory including a volatile memory 1314 and a non-volatile memory 1316 via a bus 1318. The volatile memory 1314 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 1316 may be implemented by flash memory and/or any other desired type of memory device. Access to the main memory 1314, 1316 is controlled by a memory controller.

The computer 1300 also includes an interface circuit 1320. The interface circuit 1320 may be implemented by any type of interface standard, such as an Ethernet interface, a universal serial bus (USB), and/or a PCI express interface.

One or more input devices 1322 are connected to the interface circuit 1320. The input device(s) 1322 permit a user to enter data and commands into the processor 1312. The input device(s) can be implemented by, for example, a keyboard, a mouse, a touchscreen, a track-pad, a trackball and/or a voice recognition system.

One or more output devices 1324 are also connected to the interface circuit 1320. The output devices 1324 can be implemented, for example, by display devices (e.g., a liquid crystal display, a cathode ray tube display (CRT). The interface circuit 1320, thus, typically includes a graphics driver card.

The interface circuit 1320 also includes a communication device such as a modem or network interface card to facilitate exchange of data with external computers via a network 1326 (e.g., an Ethernet connection, a digital subscriber line (DSL), a telephone line, coaxial cable, a cellular telephone system, etc.).

The computer 1300 also includes one or more mass storage devices 1328 for storing software and data.

Examples of such mass storage devices 1328 include floppy disk drives, hard drive disks, compact disk drives and digital versatile disk (DVD) drives. The mass storage device 1328 may implement a local storage device.

The coded instructions of FIG. 12 may be stored in the mass storage device 1328, in the volatile memory 1314, in the non-volatile memory 1316, and/or on a removable storage medium such as a CD or DVD.

From the foregoing, it will appreciate that the above disclosed methods and apparatus and articles of manufacture describe labels having tags and/or pattern release layers that enables a product to which the label is attached to verified for authenticity and/or to substantially identify any tampering therewith. In some examples, the labels include label stock, transfer tape and a chip positioned between the label stock and the transfer tape and/or a voidable tag (e.g., an RFID tag). To substantially prevent the label from being removed from, for example, a product and affixed to another product, the label stock has a pattern release layer that voids if removed (e.g., visual identifier). To substantially prevent the label from being removed from, for example, a product and affixed to another product, first adhesive of the label stock coupled to the tag is not as strong as second adhesive of the transfer tape. Thus, if the label stock is removed from the product to which it is attached, the difference in first and second adhesive strengths enables the tag to remain attached to the transfer tape and for the tag to separate from the label stock. In some examples, the tag is part of an inlay. In other examples, the tag and/or its chip and/or its antenna are placed and/or printed directly on the label stock and/or the transfer tape.

Although certain example methods, apparatus and articles of manufacture have been described herein, the scope of coverage of this patent is not limited thereto. On the contrary, this patent covers all methods, apparatus and articles of manufacture fairly falling within the scope of the claims of this patent.

What is claimed is:

1. A method, comprising:

applying a first pattern of a first adhesive including a tamper evident pattern release layer on a first side of a first substrate, the first substrate further including a second side opposite the first side;

applying a second pattern of a second adhesive disposed on the first side, the second pattern of the second adhesive being surrounded by the first pattern of the first adhesive;

forming a removable portion and a remaining portion on a third side of a tag, the tag further including a fourth side opposite the third side;

coupling the third side of the tag to the first substrate, with the remaining portion positioned adjacent the first pattern of the first adhesive and the removable portion positioned adjacent the second pattern of the second adhesive; and mating transfer tape of a second substrate over the first pattern of the first adhesive and the tag, the second substrate further including a liner, the transfer tape including a third pattern of the second adhesive to be positioned adjacent the remaining portion of the tag and the first pattern of the first adhesive.

2. The method of claim 1, further including forming a line of weakness to define the removable portion on the tag to enable the removable portion to be torn from the tag along the line of weakness and enable the tag to be disabled upon an associated label being tampered with.

3. The method of claim 2, wherein applying the second pattern of the second adhesives includes spot coating the first side with second adhesive adjacent to where the line of weakness is to be positioned.

4. The method of claim 1, wherein the removable portion includes a bridge formed on an antenna of the tag, the bridge to be removable from the antenna to disable the tag upon an associated label being tampered with.

5. The method of claim 4, wherein the bridge is printed on the tag.

6. The method of claim 4, further including printing a release layer between the tag and the bridge.

7. The method of claim 4, further including spot coating the first side with the second adhesive adjacent to where the bridge is to be positioned.

8. The method of claim 1, wherein the tag includes a radio-frequency identifier tag or a near field communication tag.

9. The method of claim 1, further including printing an antenna for the tag on the first side of the substrate.

10. The method of claim 1, further including cutting the first substrate and the transfer tape to form a label, wherein the tag is positioned between the first substrate and the transfer tape.

11. The method of claim 10, further including removing a waste matrix formed from the cutting, the waste matrix including a portion of the first substrate and of the transfer tape.

12. The method of claim 11, further including forming a line of weakness in the liner to separate the label from a second label positioned adjacent thereto.

13. The method of claim 1, wherein the transfer tape further includes a film and a fourth pattern of the second adhesive, the film being between the third and fourth patterns of the second adhesive, the fourth pattern of the second adhesive being between the film and the liner.

14. The method of claim 13, wherein the second adhesive is stronger than the first adhesive.

15. The method of claim 14, wherein the tamper evident pattern release layer is disposed on a first portion of the first substrate, the tamper evident pattern release layer is to overlay the second adhesive to enable the first portion of the first substrate to decouple from the second substrate upon the first substrate being separated from the second substrate to enable a visual indication of tampering.

16. The method of claim 15, wherein a second portion of the first substrate spaced from the tamper evident pattern release layer is to remain coupled to the second substrate upon the first substrate being separated from the second substrate to enable the visual indication of tampering.

17. The method of claim 1, wherein, prior to coupling the third side of the tag to the first substrate, cutting the tag from a third substrate including a second tag to separate the tag from the second tag.

18. The method of claim 1, further including removing the liner from the transfer tape.

19. The method of claim 18, further including coupling the transfer tape to a third substrate.

20. The method of claim 19, wherein the third substrate includes a container, a product, or a pallet.

21. The method of claim 1, further including establishing disablement of the tag via a tear along a line of weakness formed in the tag to define the removable portion upon an associated label being tampered with.

22. The method of claim 1 wherein the removable portion includes a bridge and further including establishing disablement of the tag via the bridge to provide a break in an antenna of the tag upon an associated label being tampered with.

23. The method of claim 1, wherein the tag includes a first tag, further including coupling a second tag to the first side of the first substrate; and coupling the second substrate to the second tag, a first label being associated with a first portion of the first substrate, the first tag, and a first portion of the transfer tape, a second label being associated with a second portion of the second substrate, the second tag, and a second portion of the transfer tape.

24. The method of claim 23, further including printing first indicia on the second side of the first substrate associated with the first label and second indicia on the second side of the first substrate associated with the second label.

25. The method of claim 24, wherein the first indicia includes a quick response code.

26. The method of claim 1, wherein the second pattern of the second adhesive causes the removable portion to be torn from the tag during a subsequent tampering of the first substrate, the remaining portion left intact.

* * * * *